US005596952A

United States Patent [19]

Lannes et al.

[11] Patent Number: 5,596,952

[45] Date of Patent: Jan. 28, 1997

[54] INDIRECT WATER HEATER

[75] Inventors: Eric M. Lannes, Kentwood, Mich.; Charles W. Staats, Yeadon, Pa.

[73] Assignee: Bradford White Corporation, Ambler, Pa.

[21] Appl. No.: 506,094

[22] Filed: Jul. 24, 1995

[51] Int. Cl.[6] ..... F22B 5/00

[52] U.S. Cl. ..... 122/13.1; 122/32; 165/154

[58] Field of Search ..... 122/13.1, 32, 33; 165/154, 155

[56] References Cited

U.S. PATENT DOCUMENTS

| | | | |
|---|---|---|---|
| 3,083,662 | 4/1963 | Zeidler | 165/155 |
| 3,776,302 | 12/1973 | Waszink et al. | 165/82 |
| 4,305,454 | 12/1981 | Kaehler | 165/108 |
| 4,416,222 | 11/1983 | Staats | 122/13 R |
| 4,438,806 | 3/1984 | Kaehler | 165/108 |
| 4,632,180 | 12/1986 | Lauderdale | 165/70 |
| 4,637,347 | 1/1987 | Troy | 122/20 |
| 4,798,240 | 1/1989 | Gerstmann et al. | 165/48.1 |
| 4,848,616 | 7/1989 | Nozaki | 219/322 |
| 5,023,928 | 6/1991 | Houle et al. | 392/457 |
| 5,233,970 | 8/1993 | Harris | 126/351 |
| 5,357,906 | 10/1994 | Brazier | 122/32 |
| 5,372,185 | 12/1994 | Lannes | 165/70 |

FOREIGN PATENT DOCUMENTS

| | | |
|---|---|---|
| 0025003 | 3/1981 | European Pat. Off. . |
| 0086967 | 8/1983 | European Pat. Off. . |
| 2088030 | 6/1982 | United Kingdom . |

*Primary Examiner*—Noah P. Kamen
*Attorney, Agent, or Firm*—Austin R. Miller

[57] ABSTRACT

A water heater is provided for connection to a heated fluid source for transfer of heat from the heated fluid to water in the water heater. The water heater includes a shell having a water storage tank and a heat exchange chamber mounted within the tank. The water heater also has an inlet tube and outlet tube for the introduction and removal of water from the tank. A supply line is connected to the heat exchange chamber to introduce heated fluid into the chamber. A return line, also connected to the heat exchange chamber, removes fluid for reheating. Water stored in the tank is heated by heat exchange from heated fluid recirculated through the heat exchange chamber.

26 Claims, 4 Drawing Sheets

INDIRECT WATER HEATER

BACKGROUND OF THE INVENTION

This invention provides an efficient and inexpensive water heater. In particular, it provides a water heater that utilizes heat generated by a separate heat source that would otherwise be wasted. The invention also provides a water heater with a supplemental heat source that is activated when heat generated by the separate heat source is inadequate to heat water in the water heater.

1. Field of the Invention

Conventional water heaters that use gas, electricity or oil to directly heat stored water are manufactured in large quantities on a daily basis. Such direct water heaters have been improved over the years to take advantage of various design and manufacturing efficiencies.

Attempts have been made to develop a water heater capable of efficiently and inexpensively heating water using heat generated indirectly by a separate heat source. However, many existing indirect water heaters have not enjoyed the same degree of refinement as direct water heaters and there remains a demand for a practical and efficient indirect water heater design. For example, typical heal exchangers in conventional indirect water heaters utilize expensive, specialized materials and have complicated and expensive designs.

2. Objects of the Invention

It is an object of this invention to provide an inexpensive and efficient indirect water heater.

It is another object of this invention to provide an indirect water heater capable of incorporating refined design elements and manufacturing methods conventionally used with direct water heaters.

It is still another object of this invention to provide a water heater that economically utilizes heat generated by a separate heat source to heat water stored in the water heater.

SUMMARY OF THE INVENTION

The indirect water heater of this invention replaces the combustion products of conventional gas-fired and oil-fired direct water heaters with a heated fluid as a primary heat source to transfer heat to water in a storage tank. The water heater has a storage tank and a substantially enclosed heat exchange chamber mounted within the storage tank. The chamber preferably has a section that extends to the tank's outer wall and is preferably located in a bottom portion of the tank.

Heated fluid is introduced into the chamber from a separate heat source such as a boiler, for example, and the heated fluid circulated through the chamber transfers heat to water in the storage tank. The fluid returns to the heat source from the chamber for reheating.

The water heater preferably includes various components from conventional water heaters as well as a supplemental heat source such as an electric heater with a heating element that extends into the storage tank. The supplemental heat source heats water in the water heater when the heat generated by the separate heat source is inadequate to heat the water in the tank.

DETAILED DESCRIPTION OF THE INVENTION

Figure 1:
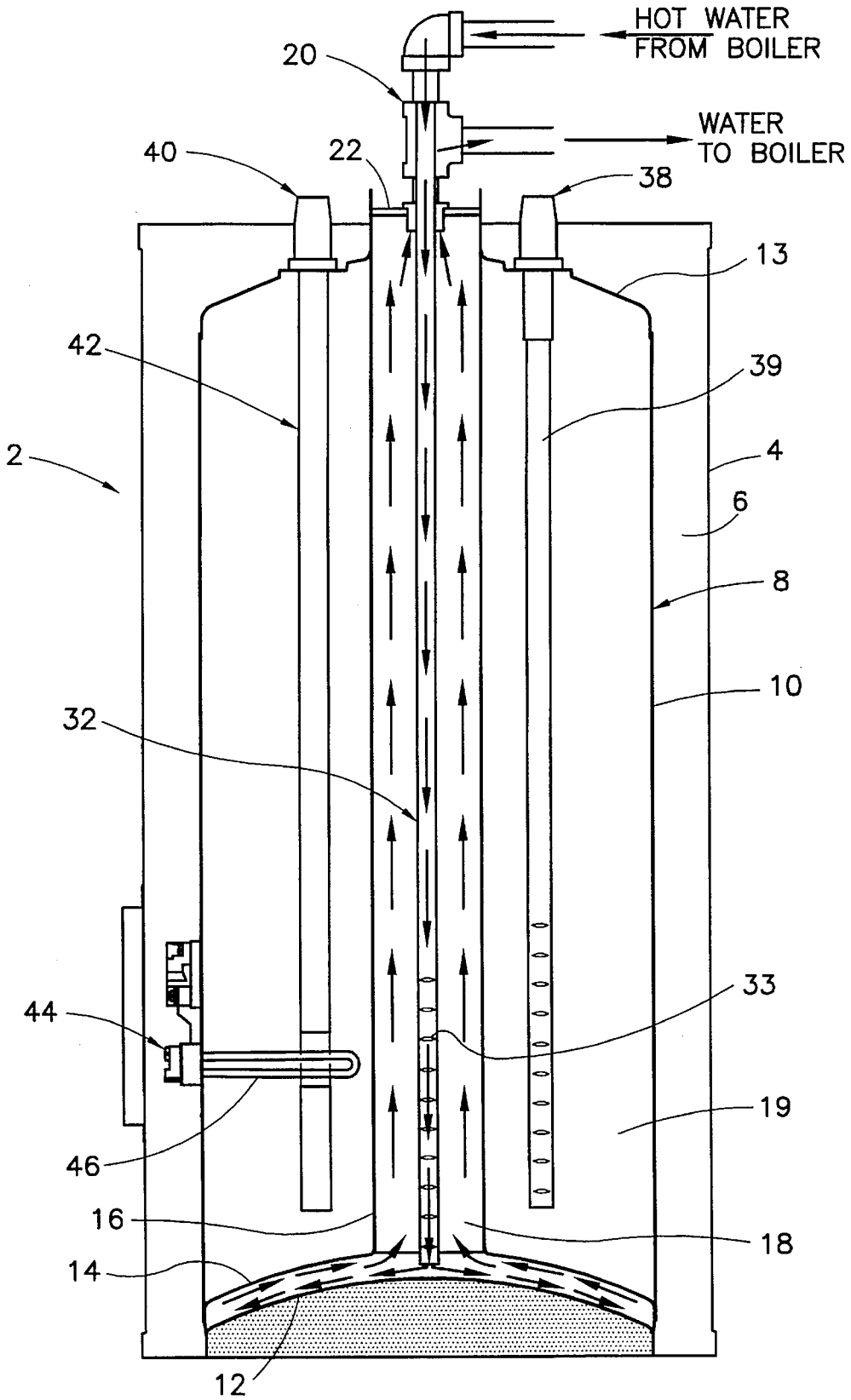
FIG. 1 is a cross-sectional side view of an embodiment of the indirect water heater according to this invention.

The following description is intended to illustrate preferred embodiments of the invention. This description is not intended to limit the spirit or scope of the invention, which is defined separately in the claims that follow.

The water heater of this invention preferably utilizes a single-wall heat exchange chamber positioned in heat exchange relationship within a water storage tank to transfer heat from heated fluid within the chamber to water in the storage tank. The heated fluid in the chamber is preferably water, but is optionally replaced with any gas or liquid.

The heat exchange chamber includes a passage, most preferably a traditional flue tube that is capable of withstanding a 300-lb. per square inch (psi) hydrostatic pressure test for domestic use. The heat exchange chamber also includes an angularly arranged chamber section with which the interior of the passage communicates. The angularly arranged chamber section preferably extends from the passageway to the wall of the storage tank and is preferably positioned near the bottom of the storage tank. Such a configuration maximizes heat transfer from heated fluid in the chamber to water in the storage tank.

This chamber section is optionally formed with a typical gas-fired or oil-fired water heater base that is welded or mechanically fastened to the passage to form an interior wall, preferably capable of withstanding a hydrostatic pressure test for domestic use. A second base is preferably welded or mechanically fastened at a position spaced from the interior wall to complete the angularly arranged chamber section. This section of the chamber is optionally flat or dished, and withstands a hydrostatic pressure of about 70 psi, or any required hydrostatic pressure.

Deflectors, tabs or similar features are optionally provided on the interior surfaces of the heat exchange chamber. For example, heat exchange "fins" are optionally provided on the interior surfaces. Such fins are optionally elongated protrusions formed on the heat exchange chamber wall and oriented in circles, in spirals, in directions parallel to the flow direction of heated fluid, in directions transverse to heated fluid flow, or in any other configuration to improve heat transfer and encourage heated fluid mixing. Such features encourage turbulent fluid flow adjacent to the interior surfaces of the chamber to increase heat exchange from heated fluid in the chamber to water in the storage tank. Such features also increase the heat exchange surface area.

A fitting assembly is connected to the heat exchange chamber, preferably at a location near or at the top of the passage. The fitting assembly preferably has a single opening sized to provide flow in two directions: specifically, flow of heated fluid into the heat exchange chamber and flow of fluid from the heat exchange chamber. Such a fitting assembly is disclosed in U.S. Pat. No. 4,416,222, incorporated herein by reference. Alternatively, the fitting assembly optionally provides more than one opening to the chamber: specifically, one opening for flow of heated fluid into the heat exchange chamber and a separate opening for flow of fluid out from the heat exchange chamber, for example.

The preferred fitting assembly has an inlet supply line that extends into the heat exchange chamber and toward the bottom end portion of the passage. The inlet supply line is connected to a heated fluid supply line to receive heated fluid from a heat source such as a boiler, for example, and delivers the heated fluid into the heat exchange chamber. One or more deflectors are optionally provided on the surface of the inlet supply line to generate or increase vortices in the heated fluid flow. Examples of such deflectors are described in U.S. Pat. No. 5,341,770, incorporated herein by reference.

An outlet opening is provided in the fitting assembly for flow of fluid out from the heat exchanger chamber. The outlet opening preferably communicates with a fluid return line so that fluid received from the chamber is returned to the heat source for reheating. The outlet opening is optionally an annular passageway between the outside surface of the inlet supply line and the inside surface of the fitting, especially when the fitting assembly utilizes a single opening for the supply and withdrawal of fluid.

In operation, heated fluid travels from a heat source, through the heated fluid supply line, along the inlet supply line and into the heat exchange chamber. The heated fluid circulates in the heat exchange chamber and then travels out of the chamber through the outlet opening, along the fluid return line, and returns to the heat source for reheating. Heat is transferred from the heated fluid in the heat exchange chamber to the water in the water storage tank, thereby providing a source of hot water for domestic consumption or for other uses.

The water heater of this invention preferably includes a supplemental heat source to provide heat to water in the storage tank if the heated fluid supply is unavailable or insufficient to adequately heat the water. The secondary heat source is preferably an electric heating element, and most preferably a screw-mounted element, which extends into the storage tank to heat water in the tank. Such an electric heating element is preferably mounted above the angularly arranged chamber section of the heat exchange chamber, but is optionally mounted adjacent to or below such section. Examples of suitable electric heating elements are described in U.S. Pat. Nos. 4,848,616 and 5,023,928, both of which are incorporated herein by reference.

A screw-mounted element is optionally replaced with a flange-mounted element, for example, or an equivalent element. Also, it is contemplated that the secondary heat source is optionally a combustible fuel burner such as a gas-fired or oil-fired burner used in conventional water heaters.

DESCRIPTION OF THE PREFERRED EMBODIMENTS

The specific embodiments of this invention shown in the drawings are provided for illustrative purposes and not to limit the scope of the invention, which is defined separately in the claims.

Referring to FIG. 1, the numeral "2" generally indicates an embodiment of the water heater according to this invention. Water heater 2 has an outer jacket 4 which encapsulates a layer of thermal insulation 6. Within thermal insulation 6 is mounted a shell 8.

Shell 8 is formed by an outer wall 10, a base 12 and a lid 13. An interior or internal wall 14 is mounted within shell 8 at a position spaced from base 12. A passage indicated by the numeral "16" is mounted within shell 8, connected at its bottom end to interior wall 14 and at its top end to lid 13. Interior wall 14 is angularly arranged with respect to the axis of passageway 16. Also, interior wall 14 extends radially outwardly from passageway 16 to outer wall 10 of shell 8.

A substantially enclosed heat exchange chamber 18 is formed by the upper surface of base 12, the lower surface of interior wall 14 and the interior surface of passage 16. The lower portion of chamber 18 forms an angularly arranged chamber section. A water storage tank 19 is formed by the upper surface of interior wall 14, the outer surface of passage 16 and the inside surface of outer wall 10.

Water heater 2 is provided with a port assembly 20, which is described in detail with reference to FIG. 2. Port assembly 20 provides for fluid flow into and out from chamber 18 as indicated generally by the arrows in FIG. 2.

Figure 2:
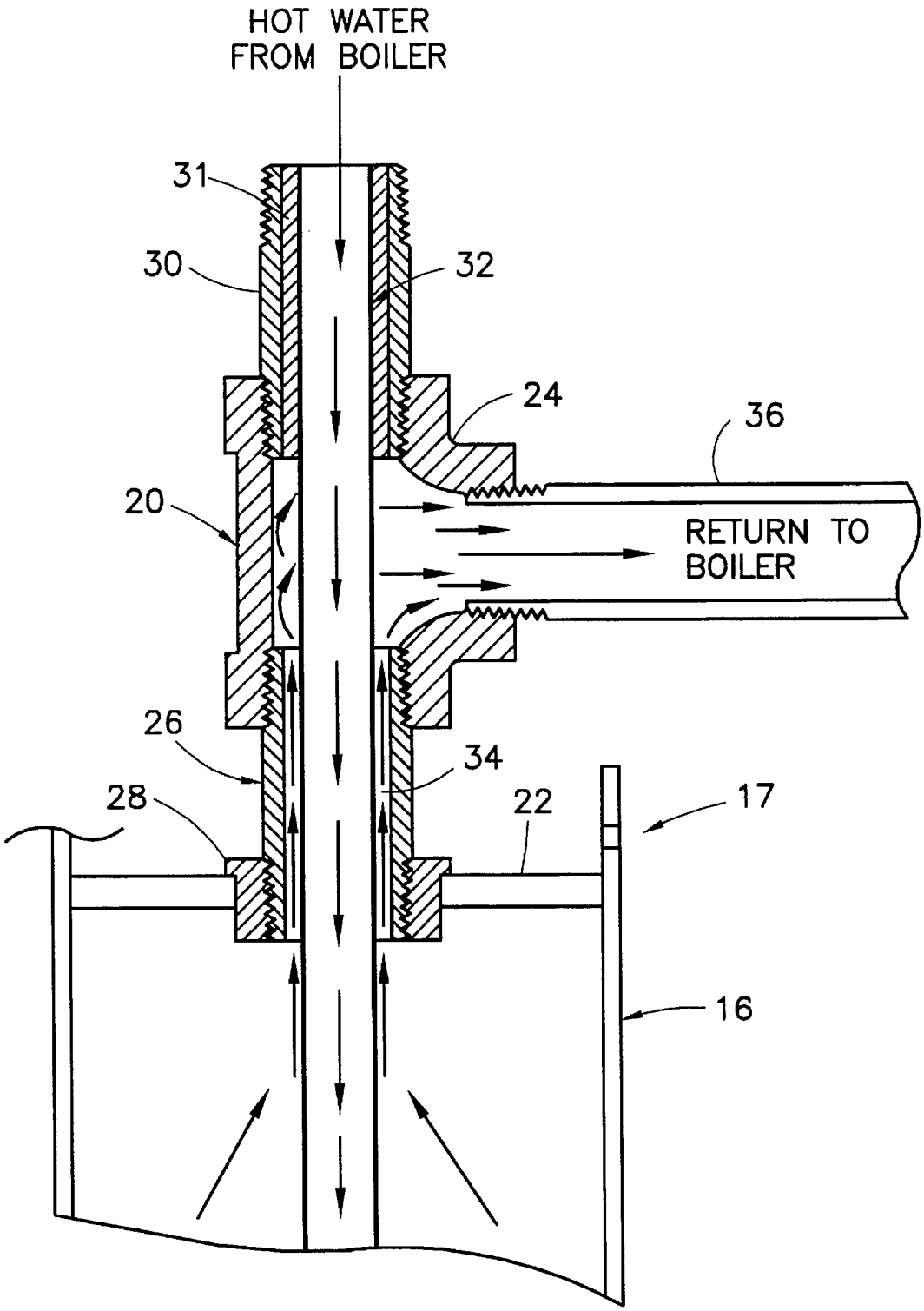
FIG. 2 is a cross-sectional side view of one embodiment of a fitting assembly adapted for use with the indirect water heater shown in FIG. 1.

Referring to FIG. 2, port assembly 20 is connected to passage 16 by means of a cap 22. Port assembly 20 includes a "tee" fitting 24 threaded onto a nipple 26 and onto a nipple 30. Nipple 26 is threaded into the female pipe threads of a weld fitting 28. Fitting 28 is welded to cap 22 which, in turn, is welded or mechanically fastened to passage 16. Fitting 24 and nipple 26 are optionally replaced with a "street" fitting with male pipe threads for mounting in weld fitting 28. A hole 17 is provided near the top of passage 16 for holding passage 16 while it is being transported and enamelled, for example, during the manufacturing process.

A supply line 32 is mounted within port assembly 20, insulated by a liner 31. Supply line 32 extends into and toward the bottom end portion of passage 16 as shown in FIG. 1. An annular flow passage 34 is formed between the outer surface of supply line 32 and the inner surfaces of tee 24 and nipple 26. A return line 36 is connected to tee 24 and communicates with flow passage 34.

Referring again to FIG. 1, water heater 2 includes a cold water inlet port 38 and a hot water outlet port 40, shown in this embodiment in the lid 13 near the top of water heater 2. Cold water inlet port 38 introduces cold water into water storage tank 19. Hot water outlet port 40 removes hot water from water storage tank 19. Hot water outlet port 40 has a sacrificial anode 42 provided to reduce corrosion in the tank. Cold water inlet port 38 is provided with a dip tube 39 so that cold water is introduced near the bottom portion of water storage tank 19. Dip tube 39 is optionally provided with deflectors such as those disclosed in U.S. Pat. No. 5,341,770, incorporated herein by reference.

Supply line 32 is preferably provided with deflectors 33 to encourage turbulent fluid flow within supply line 32 and in chamber 18. For examples of suitable deflectors, see U.S. Pat. No. 5,341,770, incorporated herein by reference. Specifically, optional deflector shapes and configurations are illustrated in FIGS. 2–13 of that patent. Turbulent flow increases heat transfer from heated fluid in chamber 18 to water in water storage tank 8. Similar deflectors or fins are optionally positioned on the upper surface of base 12, the lower surface of interior wall 14 and the interior surface of passage 16. Deflectors 33 on inlet supply line 32 optionally include openings, but such openings are not required and may not be desired depending upon the location of the deflectors with respect to heated fluid flow. Deflectors optionally positioned on base 12, internal wall 14 and passage 16 would not include openings so as to maintain the integrity of shell 8 and to maintain separation between heated fluid within chamber 18 and water stored within tank 19.

Water heater 2 preferably includes a supplemental heat source such as one or more electric heaters 44 mounted in outer wall 10 of shell 8. Electric heater 44 has a heating element 46 which extends through outer wall 10 of shell 8 and into water storage tank 19 so as to heat water in the tank. The supplemental heat source heats water in water storage tank 19 when the primary source for heated fluid is inoperative or insufficient.

In operation, heated fluid, preferably hot water, is introduced to supply line 32 from a heat source such as a boiler and into chamber 18, thereby causing heat transfer to water stored in tank 19. Heated fluid then exits chamber 18 through flow passage 34 and travels through return line 36 to the heat source for reheating.

Hot water is drawn from hot water outlet port 40 as it is needed. Drawn hot water is replaced by cold water introduced into tank 19 through cold water inlet port 38. Heat transfer from heated fluid in chamber 18 to water in tank 19 provides a constant source of hot water.

Electric heater 44 and heating element 46 optionally provide heat to water in tank 19 when necessary. For example, electric heater 44 is connected to a thermostat and to a controller and is activated when the source for heated fluid, such as a boiler, is inoperable. Electric heater 44 is also optionally activated if heat transfer from heated fluid in chamber 18 to water in tank 19 is insufficient to meet hot water demands. Further details of this aspect of the invention are provided below with reference to FIG. 4.

Many modifications are optionally made to the embodiment shown in FIGS. 1 and 2 without departing from the scope of the invention. For example, although a boiler has been described as the source for heated fluid, a boiler is optionally replaced with any other known heat source such as, for example, a solar heater, a conventional water heater, a heat pump or any other source of hot fluid. Also, the heated fluid, though preferably hot water, is optionally any gas or fluid.

Similarly, one or more electric heaters 44 are optionally replaced with another supplemental heat source. A conventional combustible fuel heat source such as a gas-fired or oil-fired burner is optionally used. For example, a combustion chamber is optionally positioned below base 12 of water heater 2 (FIG. 1) and combustion gases are optionally exhausted through one or more flues extending through or around base 12, interior wall 14, tank 19 and lid 13, or in one of many other possible configurations.

Port assembly 20 is optionally replaced with a multi-port assembly, such as the one shown in FIG. 3 described below, having one port for introducing heated fluid to the chamber 18 and a separate port for removing return fluid from chamber 18. Also, chamber 18 optionally has one of many possible shapes and configurations. For example, passage 16 optionally has any cross-sectional shape, any length, or any mounting configuration. Passage 16 is provided with any cross-section size, depending upon the capacity of the water heater and other factors. Also, passage 16 optionally extends below interior wall 14 and towards base 12 to provide additional heat transfer through wall 14. It is contemplated that passage 16 is optionally mounted vertically, horizontally or in any convoluted manner. It is also contemplated that the supply and return ports for the heated fluid are optionally positioned at base 12 and that chamber 18 is formed from base 12 and a solid interior wall 14, thereby eliminating passage 16.

Although not necessary, the angularly arranged chamber section of chamber 18 is preferably positioned beneath at least a portion of water storage tank 19, and is most preferably positioned at the bottom of the tank, to maximize heat transfer as heat rises from heated fluid in chamber 18 to water in tank 19. Also, although not necessary, the angularly arranged chamber section formed by base 12 and interior wall 14 most preferably extends out to outer wall 10 to maximize heat transfer surface area.

Although heat exchange chamber 18 defined by base 12, interior wall 14 and passage 16 has been described in terms of a single-wall configuration, it is of course contemplated that these surfaces are provided with a double-wall construction to provide an additional barrier between heated fluid within the chamber and potable water in the water storage tank. A double-wall construction is optionally created by forming a second wall within the surface of the chamber or by forming a second wall on the outside surface of the chamber. Such a second wall is optionally metallic, polymeric, or elastomeric. A leak passage between such a double-wall construction is preferably provided so that heated fluid or potable water that leaks into the space between the walls can escape.

Figure 3:
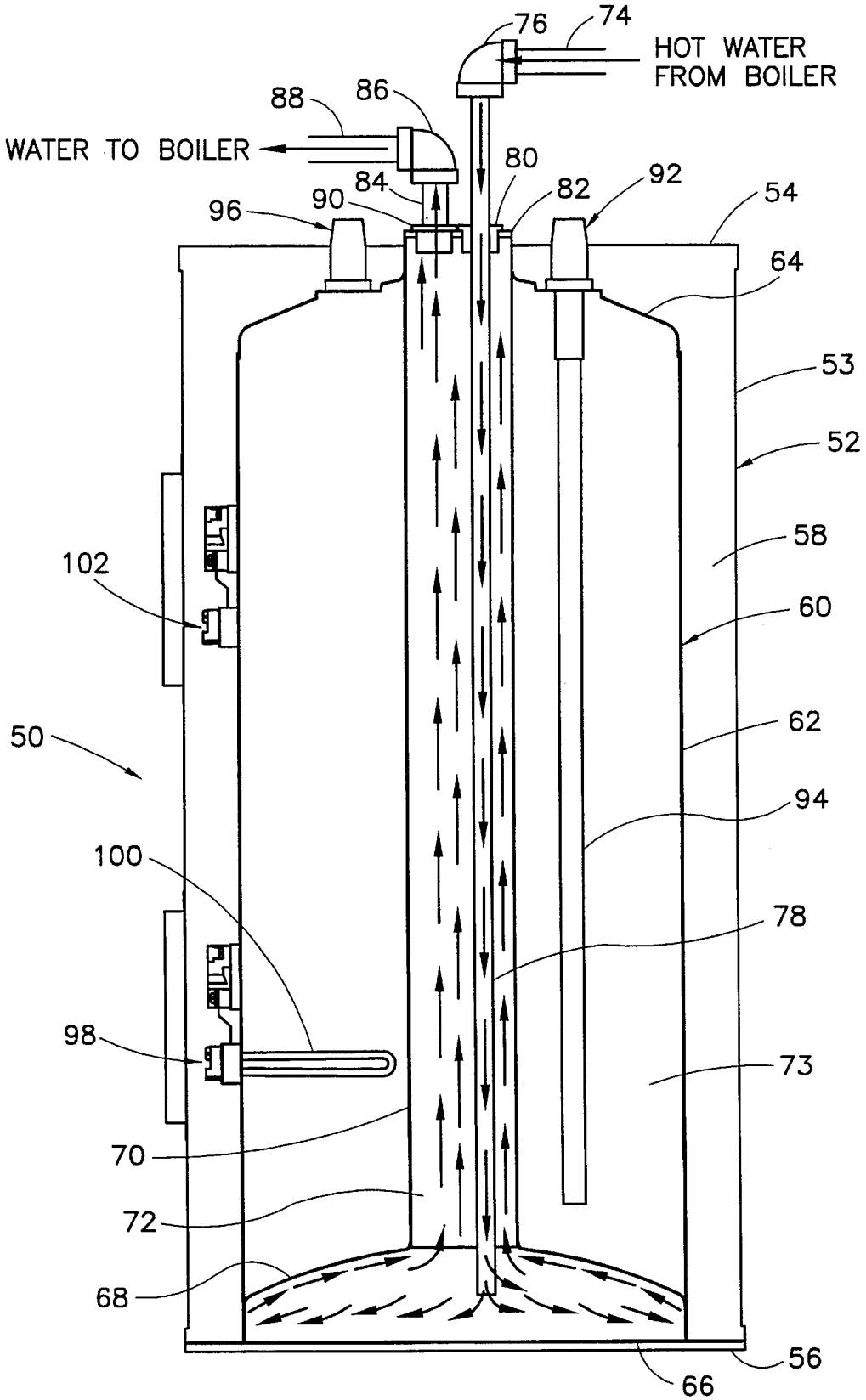
FIG. 3 is a cross-sectional side view of another embodiment of the indirect water heater according to this invention.

FIG. 3 illustrates another embodiment of this invention which incorporates various modifications. Referring to FIG. 3, a water heater generally designated "50" is provided with an outer jacket 52 having a jacket wall 53, a jacket top 54, and a jacket bottom 56. Outer jacket 52 encapsulates thermal insulation 58 which, in turn, surrounds a shell 60. Shell 60 has an outer wall 62, a lid 64, and a base 66.

Base 66 differs from the base 12 shown in FIG. 1 because base 66 is substantially flat. This configuration for base 66 has several advantages. Specifically, the flat surface makes it easier to assemble water heater 50. Base 66 optionally extends to the full diameter of jacket bottom 56 and functions to center shell 60 within jacket bottom 56. Also, a substantially flat base such as base 66 has been discovered to increase mixing of fluid adjacent the base. Finally, the configuration of base 66 reduces heat loss through the bottom of water heater 50 by reducing the surface area of the base. Although not shown, insulation is optionally provided between base 66 and jacket bottom 56 to further reduce heat loss.

Shell 60 has an interior wall 68 that is preferably welded to outer wall 62 of shell 60 or to base 66. A passage indicated by the numeral "70" is mounted within shell 60, connected at its bottom to interior wall 68 and at its top and to lid 64. A chamber 72 is formed by the upper surface of base 66, the lower surface of interior wall 68, and the interior surface of passage 70. A water storage tank 73 is formed by the upper surface of interior wall 68, the outside surface of passage 70 and the inside surface of outer wall 62.

Water heater 50 is provided with a supply line 74 which is connected by means of an elbow fitting 76 to a supply line 78. Supply line 78 is mounted to passage 70 by means of a weld fitting 80 and a cap 82.

A nipple 84 is connected to a return line 88 by means of an elbow fitting 86. Nipple 84 is mounted to passage 70 by means of a weld fitting 90 which is welded to cap 82.

Water heater 50 is provided with a cold water inlet port 92 which terminates in a dip robe 94 that extends into the interior and bottom portion of water storage tank 73. A hot water outlet port 96 is also provided and optionally has a sacrificial anode (not shown) extending into the interior of water storage tank 73.

An electric heater 98 is mounted to outer wall 62 of shell 60. Electric heater 98 includes a heating element 100 which extends through outer wall 62 and into the interior of water storage tank 73. A thermostat 102 is optionally provided in an upper portion of outer wall 62.

In operation, heated fluid, preferably water, is introduced to supply line 74 from a heat source such as a boiler and then travels into the bottom portion of chamber 72 defined by base 66 and interior wall 68. The heated fluid then exits chamber 72 through nipple 84, elbow fitting 86, and return line 88. The fluid returns to the heat source for reheating.

Cold water is introduced into water storage tank 73 through cold water inlet port 92 and dip tube 94. Heat from heated fluid within chamber 72 is transferred to water within water storage tank 73. Hot water is then drawn from water storage tank 73 through hot water outlet port 96 as it is needed for domestic or other use.

When the heat source is not operating, or when the capacity of the heat source is insufficient, electric heater 98 and heating element 100 are activated to provide secondary heating to water within water storage tank 73. Thermostat 102 senses the temperature of water within water storage tank 73 and controls the boiler or one or more circulation pumps.

Figure 4:
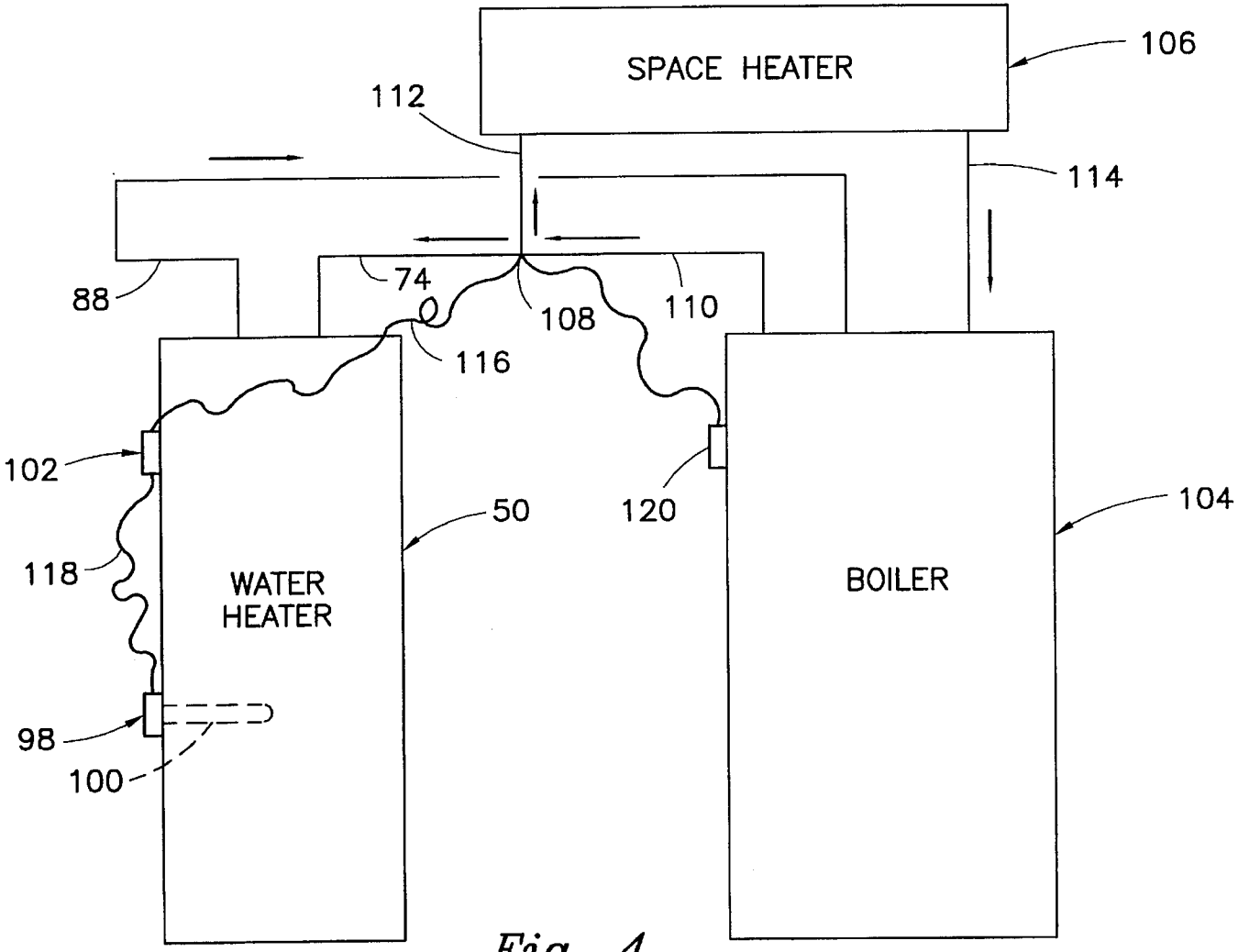
FIG. 4 is a schematic representation of an embodiment of a system which includes a water heater according to this invention.

FIG. 4 illustrates, in schematic form, one of many possible systems capable of utilizing the water heater of this invention. The system illustrated in FIG. 4 includes water heater 50 (from FIG. 3), a boiler 104 and a space heater 106.

Water heater 50 has electric heater 98 with a thermostat and a heating element 100 as well as a separate thermostat 102. Boiler 104 is provided with a thermostat 120 positioned to measure the temperature of water in boiler 104. Space heater 106 is any known space heating system such as a heat radiator, for example.

As indicated by the arrows, heated fluid (preferably hot water) flows from boiler 104 to a zone valve indicated at numeral "108" through a line 110. Water flows from valve 108 to water heater 50 through supply line 74. Water returns from water heater 50 to boiler 104 through return line 88.

Water also flows from valve 108 to space heater 106 through a line 112. Water returns to boiler 104 from space heater 106 through a line 114.

In normal operation, water stored in water heater 50 is heated as hot water flows from boiler 104, through line 110, past valve 108, through line 74, and into the heat exchange chamber of water heater 50. Heat is then transferred from hot water in the heat exchange chamber to water stored in the water storage tank. Water then returns from the heat exchange chamber in water heater 50 to boiler 104 for reheating through line 88.

When the temperature sensed by thermostat 102 on water heater 50 rises to a preset maximum temperature, a signal is communicated from thermostat 102 to valve 108 through a connection 116, causing valve 108 to close and prevent further flow of hot water from boiler 104 to water heater 50. This prevents overheating of water stored in water heater 50.

Heating element 100 of electric heater 98 is activated when the temperature sensed by the thermostat of heater 98 falls below a preset minimum temperature. This occurs when heat transferred from the water delivered from boiler 104 to the heat exchange chamber of water heater 50 is insufficient to heat water stored in water heater 50, either because boiler 104 is inoperative or the hot water demand from water heater 50 is too great.

When heater 98 is activated, a signal is optionally sent to valve 108, causing valve 108 to close and prevent further flow of water from boiler 104 to water heater 50. This prevents the circulation of cold water through water heater 50, and the associated heat loss, if boiler 104 is inoperative.

When thermostat 120 on boiler 104 senses that the water temperature within the boiler has fallen below a present minimum, then a signal is sent from thermostat 120 to valve 108, causing valve 108 to close and prevent water from flowing to water heater 50 from boiler 104. This prevents the circulation of water through water heater 50 when the water temperature is insufficient to heat water stored in water heater 50.

The system illustrated in FIG. 4 is optionally modified in many ways. For example, the system is optionally changed to a so-called summer-winter hook-up, wherein a coil is mounted within the boiler and water recirculated through the coil is heated by heat transferred from hot water stored in the boiler. In such a configuration, lines 88 and 110 would be connected to opposite ends of a coiled heat exchange tube mounted within the boiler. A pump is preferably provided to circulate water through the system between the boiler and the water heater. Such a pump is preferably controlled by a thermostat connected to the water heater—when the temperature of the water stored in the water heater falls below a preset minimum, the pump is activated to circulate water heated by the boiler.

In any embodiment, the water heater of this invention provides significant benefits. The water heater is capable of being manufactured using components from conventional water heaters, thereby conferring significant cost savings. For example, passage 16 (FIG. 1) or passage 70 (FIG. 3) is optionally the same tube used as a flue in conventional gas-fired or oil-fired water heaters. Also, interior wall 14 or interior wall 68 is optionally formed from a standard combustion chamber component from a gas-fired or oil-fired water heater. Base 12 is also optionally from a conventional water heater. Many other components of the water heater of this invention as well as many manufacturing processes are optionally adopted from conventional water heaters.

The indirect water heater of this invention also provides significant performance benefits. The configuration of the chamber, especially with optional deflectors and heat exchange fins, encourages heat transfer and reduces the possibility of legionella that could otherwise develop in the cold region of the water storage tank where water may stagnate. The water heater of this invention heats the entire volume of stored water and improves hot water supply. Other benefits and modifications will be obvious to those of skill in this art in view of the specification, drawings and the following claims.

What is claimed is:

1. A heater for potable water adapted for connection to a source of external heated fluid for transfer of heat from said external heated fluid to said potable water in said heater, said heater comprising:

a tank for containing and delivering heated potable water, potable water supply and potable hot water delivery means connected to said tank for introduction of potable water into said tank and for delivery of potable hot water from said tank at a target temperature;

a heat exchanger positioned within said tank and forming a substantially enclosed passageway in the form of a heat exchange chamber within said tank, said heat exchange chamber being connected to receive said external heated fluid from said external source and to transfer heat from said external heated fluid to said potable water in said tank, said heat exchange chamber including a heat exchange section which is oriented at an angle to said substantially enclosed passageway;

supply means connected to said external source and to said heat exchange chamber for introduction of said external heated fluid from said external source into said heat exchange chamber, said supply means including a supply line extending into said substantially enclosed passageway for delivery of said external heated fluid into said heat exchange chamber, wherein said external heated fluid in said supply line is in countercurrent flow with respect to said external heated fluid in said substantially enclosed passageway, thereby inducing countercurrent heat exchange between said external heated fluid in said supply line and said external heated fluid in said substantially enclosed passageway;

return means connected to said heat exchange chamber and to said external source for returning said external heated fluid from said substantially enclosed passageway of said heat exchange chamber to said external source for reheating;

a supplemental heater connected to said tank and positioned to heat potable water in said tank; and a control means connected for activating said supplemental heater and shutting off said supply means when heat transferred from said external heated fluid is inadequate to heat said potable water to said target temperature;

said heat exchange section which is oriented at an angle to said substantially enclosed passageway including a heat exchange wall located adjacent a base of said tank.

2. The heater defined in claim 1, wherein said supplemental heater is an electric heater mounted to said tank and extending into said tank.

3. The heater defined in claim 1, wherein said tank has a vertical axis and wherein said substantially enclosed passageway is substantially parallel to said vertical axis of said tank.

4. The heater defined in claim 1, wherein said tank has a side wall and has an elongated configuration and wherein said heat exchange section which is oriented at an angle to said passageway extends substantially sidewardly from said passageway and extends adjacent to said side wall of said tank.

5. The heater defined in claim 1, wherein said supply line and said substantially enclosed passageway are arranged as an inner tube within an outer tube, respectively.

6. The heater defined in claim 1, wherein a longitudinal axis of said supply line is substantially parallel to a longitudinal axis of said substantially enclosed passageway.

7. The heater defined in claim 6, wherein said longitudinal axis of said supply line and said longitudinal axis of said substantially enclosed passageway are substantially vertical.

8. The heater defined in claim 1, wherein said supply means and said return means are positioned in a top portion of said heater.

9. The heater defined in claim 1, wherein said supply means and said return means are connected to said heat exchange chamber through a single port in said tank.

10. The heater defined in claim 1, wherein said heat exchange wall is substantially flat.

11. A heater adapted for heating a source of potable water to a target temperature and further adapted for connection to a separate source of external heated fluid for transfer of heat from said external heated fluid to potable water in said heater, said heater comprising:

a tank having a wall including a top and a base, means positioned within said tank and forming a substantially enclosed heat exchange chamber including an elongated passageway connected to an angularly arranged chamber section, said angularly arranged chamber section extending radially from said passageway and being positioned proximal to said base of said tank;

an inlet port and an outlet port mounted to said tank for introduction of potable water into said tank and removal of potable water from said tank, respectively;

a supply line connected to said tank and to said separate source of external heated fluid and communicating with said heat exchange chamber for introduction of said external heated fluid from said separate source and into said heat exchange chamber, said supply line extending into said elongated passageway and to a position proximal to said angularly arranged chamber section, wherein countercurrent flow between external heated fluid in said supply line and external heated fluid in said elongated passageway induces countercurrent heat exchange between external heated fluid in said supply line and external heated fluid in said elongated passageway;

a return line connected to said tank and to said separate source of external heated fluid and communicating with said heat exchange chamber for receiving external heated fluid from said heat exchange chamber and delivering external heated fluid to said separate source of external heated fluid;

a supplemental heater connected to said tank and positioned to heat potable water in said tank; and a controller connected for activating said supplemental heater when the heat transferred from said external heated fluid is inadequate to heat potable water to said target temperature in said tank.

12. The heater defined in claim 11, further comprising thermal insulation substantially encapsulating said tank and an outer jacket substantially surrounding said insulation.

13. The heater defined in claim 11, wherein said supplemental heater is an electric heater extending into said tank and into heat transfer relationship with potable water in said tank.

14. The heater defined in claim 11, wherein said supply line and said return line communicate with said heat exchange chamber through a single port in said wall of said tank.

15. The heater defined in claim 11, wherein said separate source of external heated fluid is selected from a group consisting of a boiler, a solar heater, a combustible fuel-fired water heater, an electric water heater and a heat pump.

16. The heater defined in claim 11, wherein at least one deflector is provided on said supply line, said deflector having a portion projecting into a flow path of said external heated fluid and having a surface arranged at an angle to said flow path.

17. A heater for potable water adapted for connection to an external source of external heated fluid for transfer of heat from said external heated fluid to potable water in said heater, said heater comprising:

a tank for receiving and containing potable water and for delivering hot potable water;

a substantially enclosed heat exchange chamber mounted within said tank for receiving, containing and delivering said external heated fluid, said heat exchange chamber including an elongated substantially cylindrical passageway connected to an angularly arranged chamber section oriented at an angle to said elongated passageway, and said heat exchange chamber being positioned to transfer heat from said external heated fluid within said heat exchange chamber to said potable water stored within said tank;

potable water inlet means connected to a potable water supply and to said tank for introduction of potable water from said potable water supply and into said tank;

hot potable water delivery means connected to said tank for delivery of hot potable water at a target temperature from said tank;

supply means connected to said external source of external heated fluid and to said heat exchange chamber for supplying external heated fluid from said external source to said heat exchange chamber so that heat is transferred from said external heated fluid in said heat exchange chamber to potable water in said tank, said supply means including a supply line extending into said elongated passageway and to a position proximal to said angularly arranged chamber section for delivery of said external heated fluid to said angularly arranged chamber section, wherein countercurrent flow between external heated fluid in said supply line and external heated fluid in said elongated passageway induces countercurrent heat exchange from external heated fluid in said supply line to external heated fluid in said elongated passageway;

delivery means connected to said heat exchange chamber and to said external source for delivering external heated fluid from said heat exchange chamber to said external source for reheating;

a supplemental heater connected to said tank and positioned to heat potable water in said tank;

said supplemental heater also being connected to a controller for separately activating said supplemental heater when heat transferred from said external heated fluid is inadequate to heat potable water to said target temperature in said tank; and wherein said angularly arranged chamber section extends transversely across said tank, outwardly from said elongated passageway in the direction of a wall of said tank.

18. The heater defined in claim 17, wherein said elongated passageway of said heat exchange chamber is substantially parallel to a vertical axis of said tank and wherein a proximal end portion of said elongated passageway is connected to an upper portion of said tank and a distal end portion of said elongated passageway is connected to said angularly arranged chamber section at a position spaced from said upper portion of said tank.

19. The heater defined in claim 18, wherein said angularly arranged chamber section of said heat exchange chamber is positioned in a bottom portion of said tank.

20. The heater defined in claim 19, wherein said angularly arranged chamber section of said heat exchange chamber includes a wall that comprises a base of said tank.

21. The heater defined in claim 17, wherein said supplemental heater is selected from a group consisting of an electric heater and a combustible fuel burner.

22. The heater defined in claim 17, further comprising thermal insulation substantially encapsulating said tank and an outer jacket substantially surrounding said thermal insulation.

23. The heater defined in claim 17, wherein said supply means and said delivery means communicate with said heat exchange chamber through one port.

24. The heater defined in claim 17, wherein said external source of said external heated fluid is selected from a group consisting of a boiler, a solar heater, a combustible fuel fired water heater, an electric water heater and a heat pump.

25. The heater defined in claim 17, wherein at least one deflector is provided on said supply means, said deflector being formed on a wall of said supply means and projecting into a path of said external heated fluid to induce mixing of said external heated fluid as said heated fluid enters said heat exchange chamber.

26. The heater defined in claim 17, wherein at least one deflector is provided on an interior surface of said heat exchange chamber, said deflector being shaped and positioned to induce mixing of said external heated fluid as it flows through said heat exchange chamber and to increase heat transfer between said external heated fluid within said heat exchange chamber and potable water stored within said tank.

* * * * *